US012318025B2

(12) United States Patent
Cooper

(10) Patent No.: US 12,318,025 B2
(45) Date of Patent: Jun. 3, 2025

(54) MAGNETIC CONNECTION APPARATUS

(71) Applicant: BOTE, LLC, Miramar Beach, FL (US)

(72) Inventor: Corey Cooper, Destin, FL (US)

(73) Assignee: Bote, LLC, Miramar Beach, FL (US)

( * ) Notice: Subject to any disclaimer, the term of this patent is extended or adjusted under 35 U.S.C. 154(b) by 0 days.

(21) Appl. No.: 18/473,566

(22) Filed: Sep. 25, 2023

(65) Prior Publication Data

US 2024/0008667 A1 Jan. 11, 2024

Related U.S. Application Data

(63) Continuation of application No. 17/443,504, filed on Jul. 27, 2021, now abandoned, and a continuation of application No. 17/350,845, filed on Jun. 17, 2021, now abandoned, and a continuation of application No. 17/033,067, filed on Sep. 25, 2020, now abandoned.

(51) Int. Cl.
*A47G 23/02* (2006.01)
*F25D 3/08* (2006.01)

(52) U.S. Cl.
CPC ..... *A47G 23/0225* (2013.01); *F25D 3/08* (2013.01)

(58) Field of Classification Search
CPC ..... A47G 23/0225; A47G 23/02; A47G 23/0216; A47G 2023/0666; F25D 3/08; F25D 3/06
See application file for complete search history.

(56) References Cited

U.S. PATENT DOCUMENTS 3,013,688 A * 12/1961 Luning ..... A47G 23/03 248/500
3,556,341 A * 1/1971 Rains ..... A47G 23/0225 D7/510
4,678,150 A * 7/1987 Newman ..... A47G 7/047 428/912.2
4,781,255 A * 11/1988 Lock ..... H02G 3/0418 174/72 A
5,039,047 A * 8/1991 Pitzo ..... A47G 1/17 248/467
5,186,350 A * 2/1993 McBride ..... B65D 81/3886 220/729
5,641,140 A * 6/1997 Sorenson ..... A47B 13/16 403/267
6,170,088 B1 * 1/2001 Tate ..... A63B 57/35 2/200.1
6,193,202 B1 * 2/2001 Rogers ..... B60N 3/103 248/312.1
6,305,656 B1 * 10/2001 Wemyss ..... B60R 11/0241 220/628
6,344,021 B1 * 2/2002 Juster ..... A61N 2/06 600/15

(Continued)

*Primary Examiner* — Nkeisha Smith
(74) *Attorney, Agent, or Firm* — BakerHostetler

(57) ABSTRACT

Two articles, such as a cooler and an article of drinkware, are magnetically coupled to each other by interaction of a magnet disposed in a patch, which is adhesively bonded to the cooler, and a ferrous metal element disposed in the article of drinkware. The patch includes shell made of plastic material, and an adhesive layer is activated by removing a peel and stick sheet. Two patches can be provided, one with a magnet and one with a ferrous metal element, in situations where both the cooler and the drinkware are without magnetic elements.

13 Claims, 6 Drawing Sheets

(56) References Cited

U.S. PATENT DOCUMENTS 6,572,945 B2 * 6/2003 Bries ..... C09J 7/20 428/41.9
7,992,265 B2 * 8/2011 Suenaga ..... G09F 1/10 248/309.4
8,001,671 B2 * 8/2011 Mitchell ..... A47G 23/0225 29/469
9,157,573 B1 * 10/2015 Zach ..... B60N 3/102
9,894,845 B2 * 2/2018 Aller ..... B65D 25/22
10,105,012 B2 * 10/2018 Yurkovetskaya .. B65D 43/0231
10,279,980 B2 * 5/2019 James, Jr. ..... B65D 81/3813
10,292,514 B1 * 5/2019 Kuhn ..... B60N 3/103
10,369,914 B2 * 8/2019 Scott ..... A47G 23/0216
11,026,529 B2 * 6/2021 Ferraro ..... A47G 19/2261
11,141,012 B1 * 10/2021 Roffey ..... F25D 31/007
11,622,642 B2 * 4/2023 Carroll ..... A47G 19/10 220/574
2004/0084593 A1 * 5/2004 Barfield ..... B25H 3/04 248/311.2
2005/0056646 A1 * 3/2005 Gary ..... B65D 25/24 220/483
2005/0056655 A1 * 3/2005 Gary ..... B65D 25/24 220/737
2010/0154683 A1 * 6/2010 Royka ..... A47G 21/167 248/346.03
2013/0105492 A1 * 5/2013 Melgoza ..... A47G 23/0303 220/574
2016/0278557 A1 * 9/2016 Esposito ..... F16B 47/00
2018/0080700 A1 * 3/2018 Cooper ..... A45C 11/20
2018/0098653 A1 * 4/2018 Pinchuk ..... A47G 23/0208
2018/0220823 A1 * 8/2018 Lawhon ..... A47G 23/0208
2018/0255949 A1 * 9/2018 Fritz ..... A47G 19/2261
2019/0133351 A1 * 5/2019 Carroll ..... A47G 19/10
2021/0137294 A1 * 5/2021 Beyer ..... A47G 23/0225
2021/0284426 A1 * 9/2021 Kalajyan ..... B65D 81/3813
2021/0285716 A1 * 9/2021 Kalajyan ..... B65D 25/20
2021/0386229 A1 * 12/2021 Kraus ..... A47G 23/02
2021/0401207 A1 * 12/2021 Bowen ..... B65D 25/101
2022/0127003 A1 * 4/2022 Wanner ..... A47G 23/06
2022/0279982 A1 * 9/2022 Scheen ..... B65D 51/24

* cited by examiner

MAGNETIC CONNECTION APPARATUS

BACKGROUND OF THE INVENTION

1. Field of the Invention

The present invention relates generally to devices for connecting drinkware to structures used in active outdoor sports, such as coolers. In particular, the invention uses the influence of a magnetic field to detachably couple drinkware, where a ferrous metal and a permanent magnet work together in complementary fashion to achieve a fast, but breakable connection, thereby stabilizing the drinkware for use during active outdoor sports.

This application is a continuation of U.S. patent application Ser. No. 17/443,504, filed on Jul. 27, 2021 and entitled MAGNETIC CONNECTION APPARATUS. This application is also a continuation of U.S. patent application Ser. No. 17/350,845, filed Jun. 17, 2021, and entitled MAGNETIC DRINKWARE. This application is also a continuation of U.S. patent application Ser. No. 17/033,067, filed Sep. 25, 2020, and entitled MAGNETIC ACCESSORY SURFACE MOUNT. The foregoing applications are all hereby incorporated by reference in their entirety.

2. Description of the Related Art

U.S. patent application Ser. No. 17/033,067 describes stand up paddle boards (SUPs) and other aquatic devices such as kayaks having magnets disposed as a surface mounted element on the deck of the SUP or kayak.

As described in my prior application, for a wide variety of water and land vehicles, e.g., boats, automobiles, trucks, and all-terrain vehicles (ATVs), significant surrounding structures provide many opportunities to mount drink holders and other devices for holding a variety of accessories. For boats, drink holders can be hung on lifelines or mounted on wheel steering pedestals, or otherwise supported on vertical structures. Accessories like tools, flashlights, cameras, knives and other items can be stored in lazarettes, lockers, glove boxes and other structures which enclose the accessories.

Adventurers who use kayaks, canoes, rowboats and other open deck watercraft often store accessories in containers placed under seats or simply placed rested on the floor of the watercraft. Fetching the accessories does not present an appreciable problem: the adventurer can simply stop paddling or rowing, reach for the container, extract the accessory and use at will. Drinks kept in coolers, as well as accessories, are easily accessed because the adventurer uses the watercraft in a sitting position. Similarly, boats, ATVs and other land vehicles have bulk and vertical structures that keep accessories from being lost or ejected from movement of the boat or vehicle.

While it is advantageous to attach magnetically drinkware and other metallic items to a stand up paddleboard, or SUP, it is also desirable to have drinkware connected to other items used in active, outdoor sports, such as coolers. FIG. 1 is a perspective view of a cooler incorporating a unique bucket shape. The cooler 10 has a cylindrical sidewall 12, a flat circular top 14 which is connected to the cylindrical sidewall 12 by a hinge 16, which is diametrically opposed to a latch 18. Other features of the unique design include a handle 20 pivotally connected at opposite sides of the cooler 10 by opposing, angled arms 22 and 24.

In use, the cooler 10 sits on its flat bottom, on relatively flat ground, so that the top 14 is substantially horizontally disposed. Due to the strength of the cooler 10, an active sportsperson could sit on the top 14 as if it were a stool. Inside, the cooler 10 can contain ice and beverages. In certain inflatable watercraft designs, the deck of a kayak, for example, can be provided with a circular hole of approximately the same diameter as the cooler 10 so that the cooler 10 can be secured in position to provide the paddler with refreshment.

In use, a paddler, who may also be engaged in other aquatic sports such as fishing, will need a place to keep an article of drinkware, such as a stainless steel, insulated tumbler from falling into the water, or otherwise tipping over and potentially spilling contents into the watercraft. Such an event, while not dire, is at least inconvenient and messy. Coolers are available with recessed cup holes to physically receive a cup or similar diameter. Such cup holes take up space and render portable coolers bulky and cumbersome. Moreover, most coolers simply do not have any means to support an article of drinkware. To the extent that a paddler places an article of drinkware on top of the cooler 10 of FIG. 1, the drinkware could stay in place so long has neither the watercraft, nor the paddler, are moving—both events being highly unlikely for an active, outdoor sportsperson.

A need exists for a simple, elegant solution for holding drinkware in sporting environments without allowing spillage, knock-down, or loss of the drinkware during active sporting activity. A further need exists for a solution that can be retrofit, or built in with original construction, but in either event inexpensive to manufacture, simple and cost effective.

SUMMARY OF THE INVENTION

In one aspect of the invention, an apparatus includes a generally flat patch having one of a permanent magnet and a ferrous metal plate embedded in a non-metallic material, and defining a flat upper surface and a flat lower surface, an adhesive film disposed on the lower flat surface of the non-metallic material, and a peel and stick protective sheet covering the adhesive film, and being removable to expose the adhesive film when the patch is ready to be attached to a non-metallic, generally flat surface.

Preferably, many different objects can be attracted to and thus detachably coupled to the patch, such as an article of drinkware including tumblers, thermos-shaped, bottle shaped or other common shaped cups used for refreshment during sporting activities. The container is preferably made of a non-ferrous material, and more preferably, the non-ferrous material is stainless steel. Stainless steel is a type of ferrous alloy, and while it does contain iron, which is ferrous, stainless steel objects are not magnetically attractive normally, given the other components that make up the alloy. For non-ferrous containers and articles, they must be fitted with a ferrous metal component to be attracted to the patch when the patch includes a permanent magnet. Likewise, if the patch includes a ferrous metal disc, the containers or other objects must be provided with a permanent magnet, such as one fitted into the bottom of a tumbler. Other object that could be detachably coupled to the patch include keys, cameras, pocket knives, and virtually anything having ferrous metal components that are desirably carried by active, outdoor sportspeople while engaged in fishing, paddling, boating, sailing and other outdoor sports.

The base of the container, which holds either a ferrous metal plate or a permanent magnet, can be made of plastic or ceramic material, or stamped or otherwise formed metal. For connecting to surfaces with embedded magnets, the base can be made of ferrous metal and can be simply attached to the patch which includes a magnet. Alternatively, the magnet can be contained in a ferrous metal base if polarities are aligned properly to be attracted, not repulsed, by the surface to which the container is desirably attached.

Preferably, the permanent magnet, whether in the patch or in the drinkware or other object, has a residual flux density (Br) of 14.5 to 14.8 KGs, a coercive force (Hc) of >11.2 KOe and a maximum energy product (BHmax) of 49.5 to 52 MGOe. Magnets of different properties can be used, so long as the goal of forming a detachable binding of accessories to the SUP is achieved. This means that the magnet should be strong enough to resist disruption and unintentional forces, such as when the drinkware encounters an onrush of water, a violet pitch, roll or yaw motion of a boat, land vehicle, bicycle or other active sport device. Forces of up to a few foot-pounds of energy should be required to remove the drinkware from a connected surface. This allows the user to reach down and grab a tumbler and remove it from the surface with relative ease, but at the same time, inadvertent and unintentional forces, which might wherein the magnet is a rare earth permanent magnet.

Preferably, the patch includes a permanent magnet encapsulated in plastic. The plastic encapsulation is then adhesively attached to a flat surface such as the top of a cooler, and then an article of drinkware, having a ferrous metal component, is magnetically coupled to the patch. Other objects having ferrous metal components can be attached to the patch as well.

In another aspect of the invention, the patch is adhered within a recess formed in a non-ferrous metal surface. In the case of a cooler, the plastic top can be molded with a recess the size and shape of the patch, which is then adhesively bonded to the cooler in the recess. Still further variations include embedding the magnet, or a metal plate, the plastic top of the cooler when molding the top. In terms of simplicity, the patch is preferably a retrofit on a flat top of a cooler, but the patch could include original equipment, such as a magnet molded into the plastic top, or fitted into a recess and bonded to the top in the recess. Further alternatives include retrofitting a ferrous metal disc on a cooler top, embedding the metal disc in a plastic top, or bonding the metal plate within a recess formed in the top.

While the invention is described with respect to a cooler of my particular design, virtually any flat, non-ferrous metal surfaces can be adapted to have a patch attached thereto, in order to magnetically couple an object to the flat surface. For example, a fiberglass boat deck or cockpit having a flat surface can have a patch adhesively bonded thereto by removing the peel and stick protective sheet removed, and then the adhesive-coated lower surface of the patch can be pressed onto the flat boat surface where desired. A particularly desirable application is the place the patch on the cooler of FIG. 1 since the cooler is particularly adapted for use in an inflatable kayak of my invention, having a drop stitch construction which gives the hardness of strength of similarly constructed fiberglass or wooden structures. A beverage holder, i.e., drinkware, can be attached to the top of the cooler while the paddler/sportsperson is engaged in athletic maneuvers.

In another aspect of the invention, two patches can be provided where neither the cooler, nor the drinkware, have magnetic elements. A first patch, having a magnet, can be attached to the flat top of the cooler, and the second patch, having the ferrous metal element, can be attached to the flat bottom of the article of drinkware. While it is preferred to have the magnet connected to the cooler, the positions could be reversed, so that the metal plate is attached to the cooler and the magnet is attached to the drinkware.

A further object of the invention is to provide a combination of a cooler and magnetic coupler so that any object having ferrous metal can be attached to the cooler. Similarly, other aspects of the invention include any combination of a first element, such as a boat, cooler, table, chair, etc., having a flat surface of non-ferrous material, and a second element, such as a cup, tumbler, pocket knife, fishing tackle bait can, or any suitable outdoor sporting equipment, where the two elements are detachably coupled to each other through magnetic force.

Other aspects of the invention will become apparent in view of the following detailed description and claims.

DETAILED DESCRIPTION OF THE INVENTION

Figure 1:
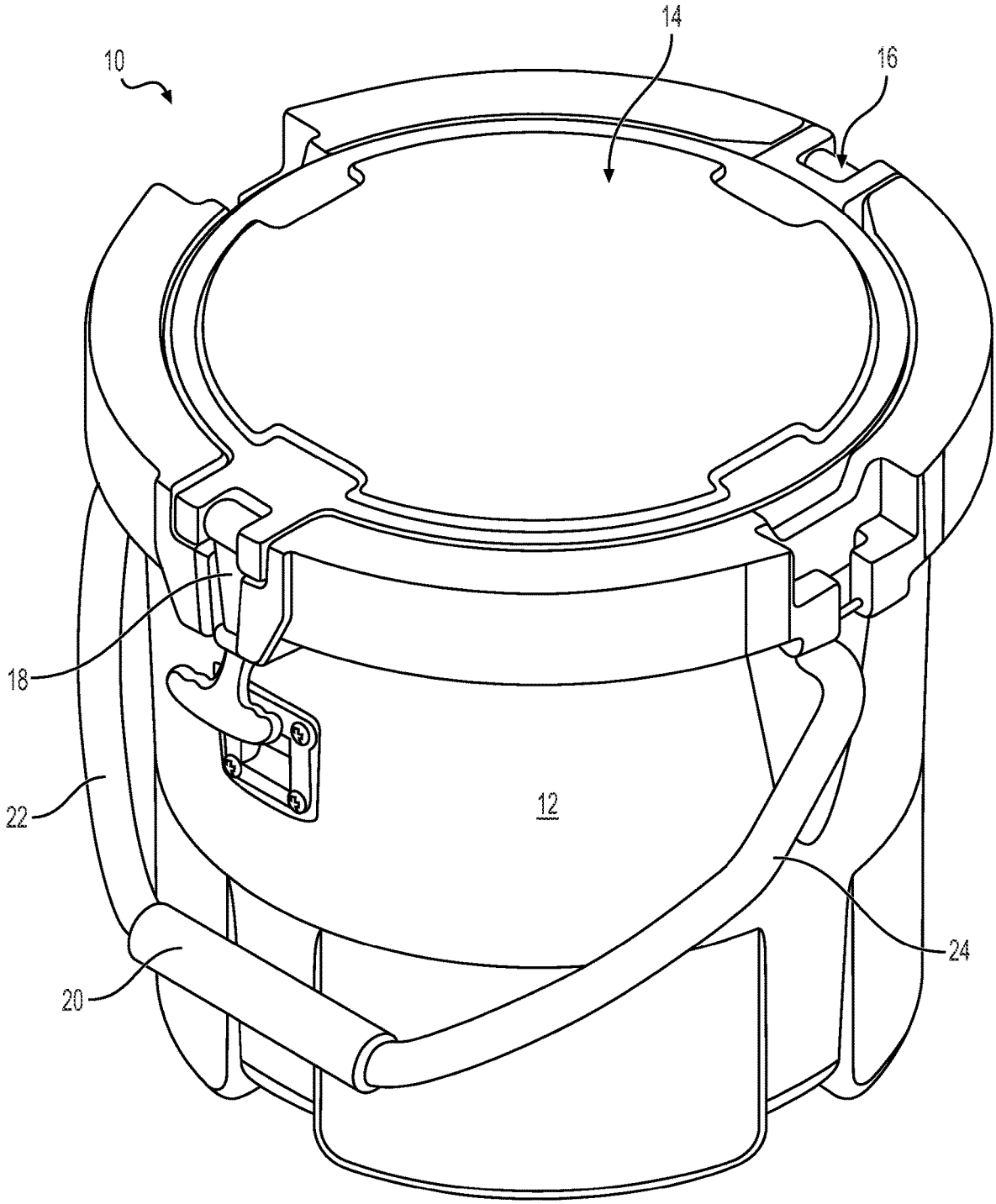
FIG. 1 (PRIOR ART)
FIG. 1 is a perspective view of a prior art cooler of generally cylindrical shape with a flat, circular top, ideally suitable for being modified to include a magnetic pad according to the present invention.
Figure 2:
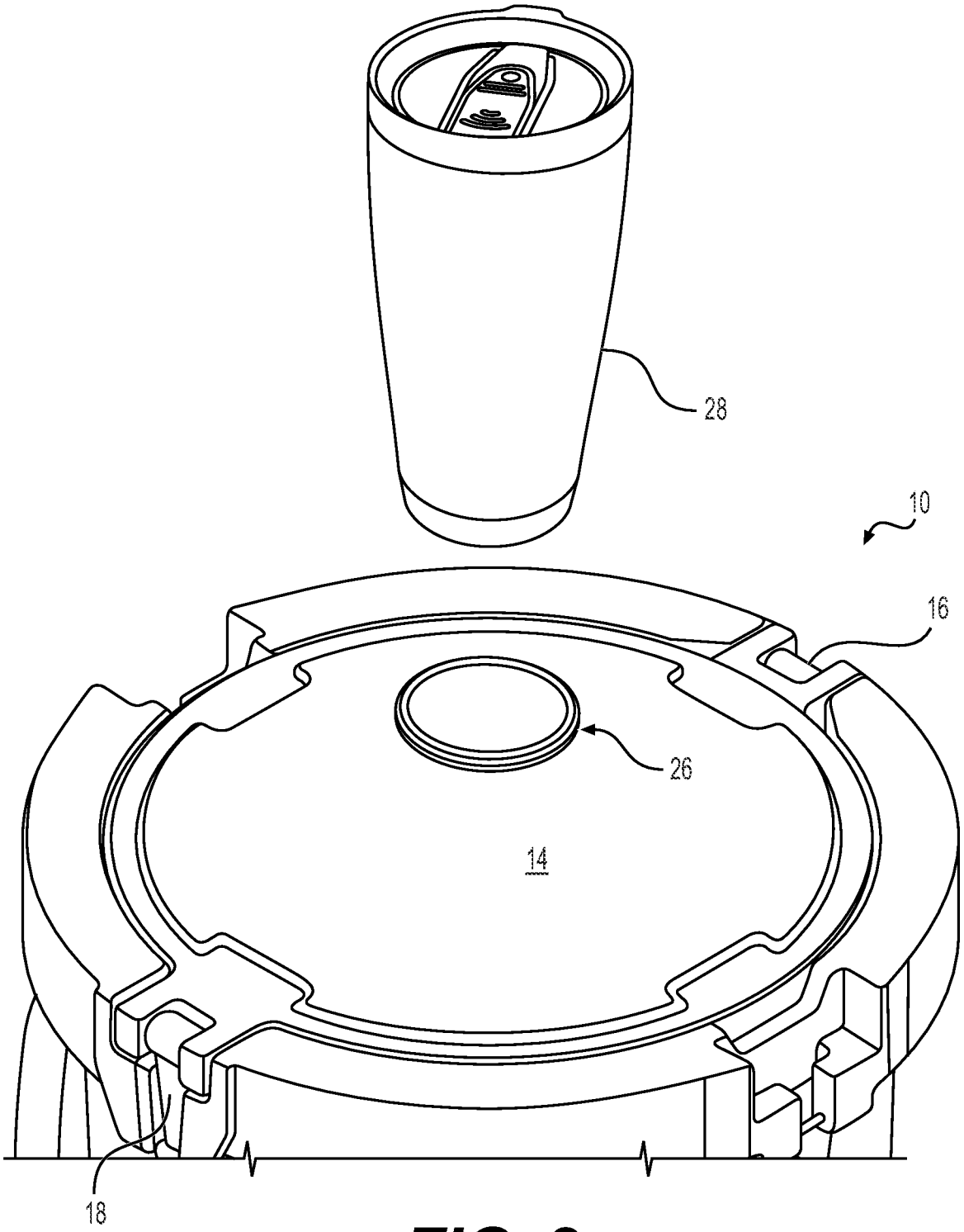
FIG. 2 is partial, top perspective view of a cooler having a magnetic patch connected to the flat top surface of the cooler, with an article of drinkware shown above the patch and aligned with the patch for magnetic coupling when the drinkware comes into the influence of the magnetic field of the permanent magnet.
Figure 3:
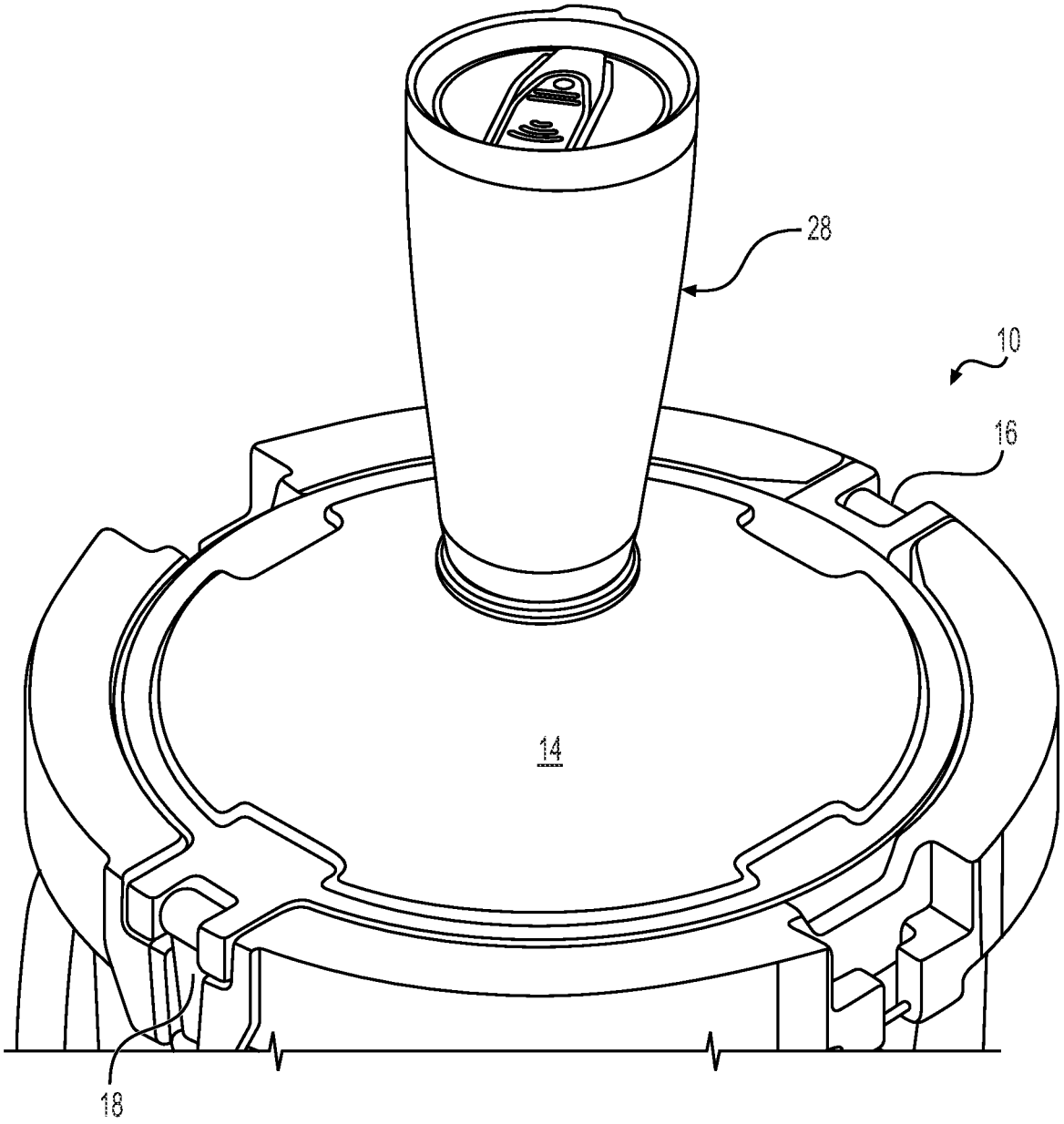
FIG. 3 is a partial, top perspective view of a cooler, similar to FIG. 2, showing the drinkware seated on the patch and magnetically, detachably coupled thereto.

Referring to FIGS. 2-3, a patch 26 is connected to the upper, flat top 14 of the cooler 10. The patch 26 is preferably a retro-fit, after market item that can be purchased separate from the cooler 10, or any other device or item to be used in a sporting, outdoor environment. The flat top 14 of the cooler 10 is made of a plastic, non-metallic material having no magnetic properties. An article of drinkware such as a liquid-containing tumbler 28 is shown above the patch 26 and is designed to be magnetically attracted to the patch 26. The patch 26 will include an adhesive film to connect the patch 26 to the top 14, as will be described more fully below. As a threshold matter, the patch 26 and the tumbler 28 have complimentary magnet and ferrous metal components so that the two will be strongly attracted to each other, thereby detachably coupling the tumbler 28 to the patch 26. For that purpose, if the patch 26 includes a magnet, the bottom of the tumbler 28 will include a ferrous metal element. Alternatively, if the patch 26 contains a ferrous metal component, the tumbler 28 will have a magnet in its base, for example.

Figure 4:
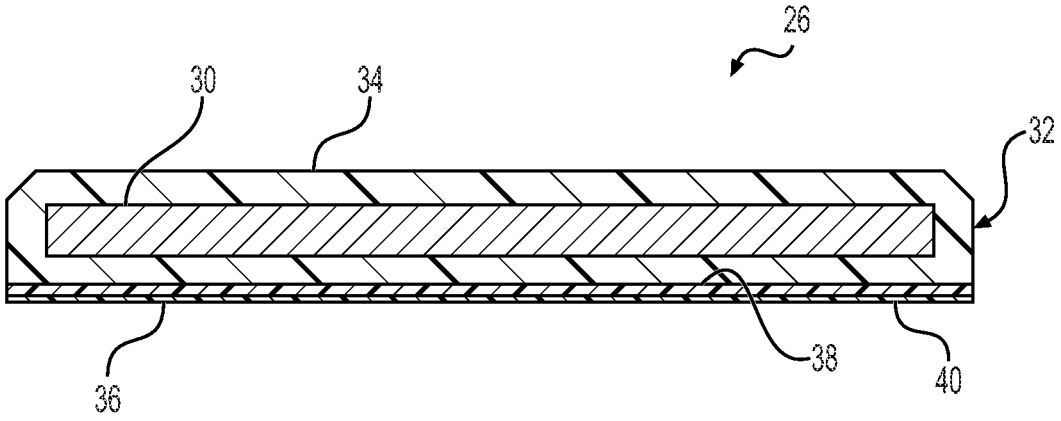
FIG. 4 is an enlarged, sectional view of the patch of FIGS. 2 and 3.

Referring to FIG. 4, the patch 26 includes a permanent magnet 30 encapsulated in a plastic shell 32. The shell 32 defines a flat upper surface 34 and a flat lower surface 36. The upper surface 34 receives an object attracted to the magnet 30 inside the patch 26 and the lower surface 36 is covered with an adhesive layer 38. The layer 38 has a peel and stick sheet 40 which is removed prior to the patch 26 being attached to a desired, flat surface.

Figure 5:
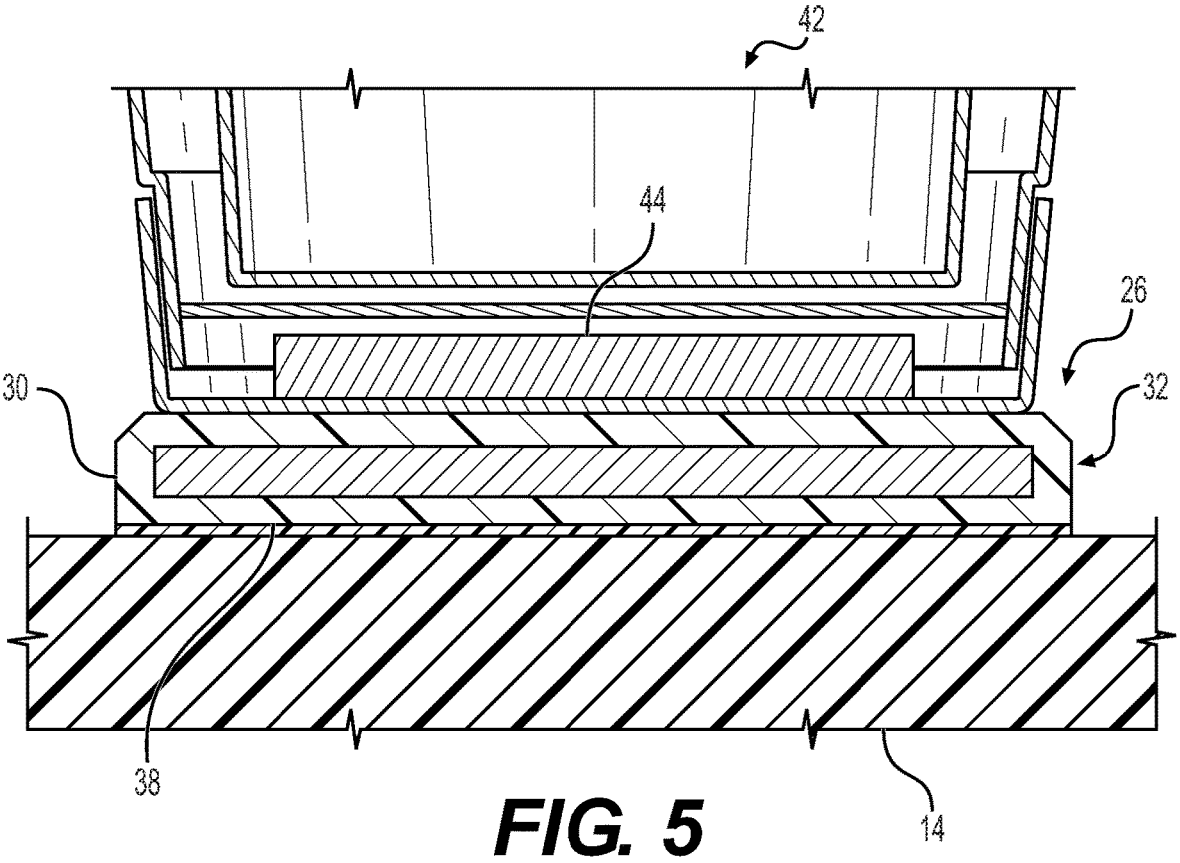
FIG. 5 is an enlarged, sectional view of the patch of FIG. 4, adhered to the top of a cooler, and having an article of drinkware detachably connected by magnetic force.

As seen in FIG. 5, after removing the peel and stick sheet 40, the patch 26 is permanently bonded to the upper surface of the top 14 of the cooler. While the cooler is used for illustration and preference, the patch 26 can be attached to many other types of structures and devices that are commonly used in active, outdoor sports. For example, the patch 26 could be attached to the flat deck or cockpit of a sailboat, a kayak, boat or similar and related devices. For magnetic coupling, the patch is preferably attached to non-ferrous metal objects, such as fiberglass decks, wooden decks, etc. An aluminum structure could be a place to adhere a patch 26 for holding ferrous metal objects as well.

A particularly preferred attachment is where the patch 26 is connected to the top 14 of a round cooler of my previous invention. An article of drinkware, such as tumbler 42, is detachably and magnetically coupled to the cooler so long as the tumbler has at least a ferrous metal component. In the illustrated embodiment, the tumbler 42 is of the type of double wall insulated stainless steel. Stainless steel does not normally have enough ferrous material to be attracted to magnets, so the tumbler 42 is provided with a metal plate 44 inside the base of the tumbler 42. The magnetic attraction between the magnet 30 and the ferrous metal plate 44 is what holds the tumbler 42 to the top 14 of the cooler.

All parts of the tumbler 42, except the magnet 30, are made of a non-ferrous material, and more preferably, stainless steel. Stainless steel is a type of ferrous alloy, and while it does contain iron, which is ferrous, stainless steel objects are not magnetically attractive normally, given the other components that make up the alloy. For purposes of this invention, "non-ferrous" thus means a material incapable of having a magnetic attraction capable of creating a holding force.

One type of stainless steel includes 11% chromium, which helps prevent iron (Fe) from becoming iron oxide ($FeO_2$). Other types of stainless steel include the elements carbon, nitrogen, aluminum, silicon, sulfur, titanium, nickel, copper, selenium, niobium and molybdenum, among others. These stainless steels are sometimes designated by a three digit number, e.g., 304 stainless, which is a preferred material for the present invention.

As illustrated in FIG. 5, the patch 26 is exaggerated in thickness for illustration purposes. In actual production, the patch 26 is as thin as possible to provide a very low profile on the cooler top. For similar reasons, a patch 26 attached to boats, picnic tables, chairs, and other objects suitable for outdoor recreation, will likewise have as thin a profile as possible. Thus, the magnet 30 can be as thin as a couple of millimeters, and the encapsulation plastic can be just thick enough to "encapsulate" and thus protect the magnet from the elements and from frictional wear with ferrous metal-containing objects that might abrade the plastic to the extent to expose the magnet. The encapsulation is thick enough to protect the magnet from both the elements and from the ferrous metal objects.

Figure 6:
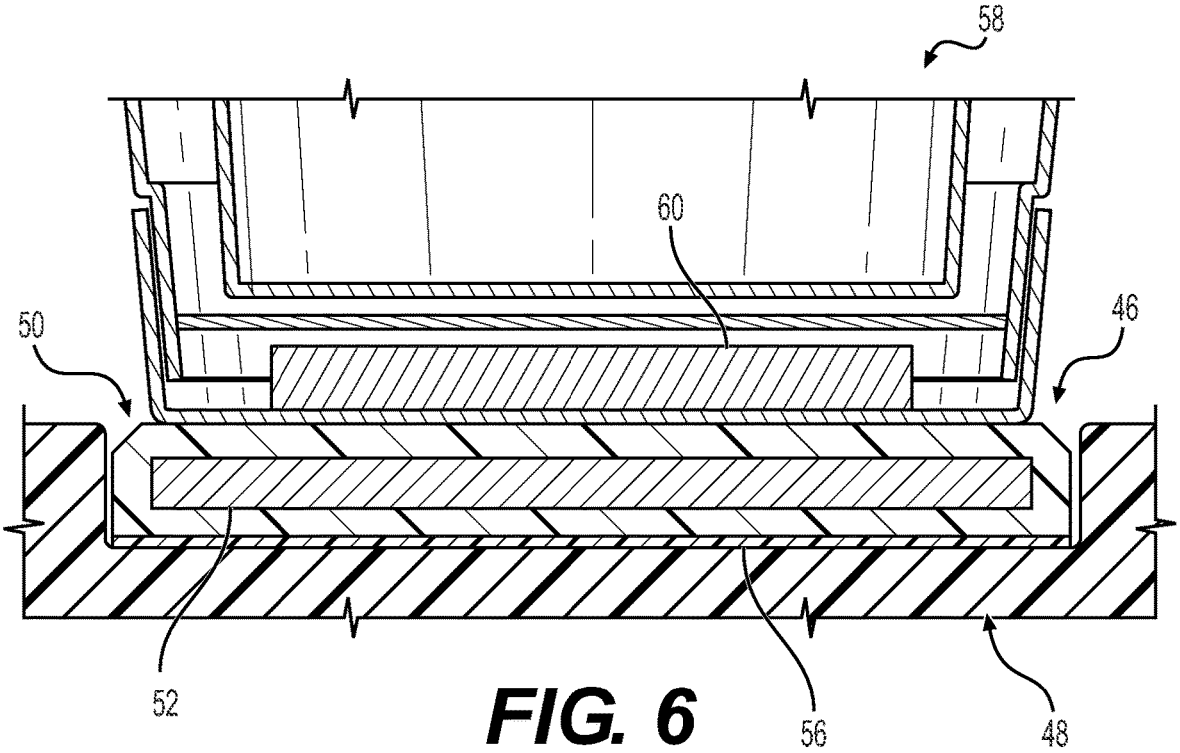
FIG. 6 is an enlarged, sectional view of an alternative patch which is placed in a recess formed in a surface.

The invention takes on at least two significant forms. First, as a retrofit, the patch can be provided separate from any objects to be connected, so that the user can stick the patch 26 on any object the user selects. As an "after-market" item, the patch 26 can be provided with special art, logos, etc., as desired. As a slight variation, the patch can be built in and thus part of the original product design. Referring to FIG. 6, a recess 46 is formed, such as by molding, in the upper surface of a cooler top 48, which is made of a non-ferrous material such as plastic. One process of making coolers is to form a shell of polyethylene and inject the shell with polyurethane. The hard exterior of the cooler would include the recess 46 as part of the molding process, although an alternative method would be to cut out a recess after the shell is formed, using rotary cutting tools or other suitable means. A patch 50 of substantially the same size and shape as the recess is fitted into the recess and bonded in place as described in the previous embodiment where an adhesive layer is provided on the patch 26.

As with the other embodiment, the patch includes a magnet 52 encapsulated in a plastic shell 54 sized and shaped to fit into the recess 46. An adhesive layer 56 can be provided to adhere the shell 54 in the recess 46. A tumbler 58, made of double walled stainless steel, includes a ferrous metal plate 60 in a bottom portion of the tumbler 58. The tumbler 58 will be detachably coupled to the top 48 when the metal plate 60 is brought into the influence of the magnetic field created by the magnet 52. As a variation, the magnet 52 can be placed by itself, without a shell, into a recess, which is then filled with a thermoplastic resin which, when hardens, encases the magnet in the recess. In that case, an adhesive layer is not necessary, nor is an encapsulating shell. Further, an object to be detachably coupled to the magnet could be an object that is made of, or includes, ferrous metal so that an additional ferrous metal plate is not necessary.

A further aspect of the invention is that the positions of the magnet 52 and the metal plate 60 can be reversed, so that the metal plate 60 is part of the patch and the magnet 52 is part of the object to be attached to the patch. For example, the tumbler 58 could include the magnet 52, instead of the ferrous metal plate 60, and the patch could include the metal plate 60, instead of the magnet 52.

A still further aspect of the invention is to provide two patches, one carrying a magnet and the other carrying a ferrous metal plate. In that embodiment, a tumbler or other object having no ferrous metal and no magnet, can be connected to a cooler having no ferrous metal and no magnet, by taking a matched pair of patches one with the magnet and one with the metal plate, and attaching one to a cooler and the other to the bottom of an article of drinkware or other object. For example, a first patch can be connected adhesively to the deck of a boat, and a second patch can be connected to the bottom of a stainless steel tumbler having no ferrous elements. In this way, a custom tumbler can be made in situ, to be made magnetically coupled to any desired surface.

It is preferred to use the strongest magnets available for a limited amount of space. For that purpose, rare earth magnets, and particularly, neodymium magnets are preferred. These are permanent magnets made from an alloy of neodymium, iron and boron to form the $Nd_2Fe_{14}B$ tetragonal crystalline structure. These are commercially available from a variety of sources, and are widely considered the strongest type of permanent magnets available commercially.

As a further alternative, and in the simplest version of the present invention, a magnet can be adhesively bonded, or attached by fasteners or brackets, to the underside of a non-ferrous surface, such as the underside of a fiberglass deck or of a thin, hard plastic top of a cooler. It this form, an article of drinkware or other object containing a ferrous metal component, will be magnetically connected to the deck, cooler or other object without further need for a separate patch. In this embodiment, the magnet need not be encapsulated in plastic because it will be protected by the upper surface of the deck or cooler. As with the other embodiments, the magnet could be a metal plate or disc when the drinkware or other object includes a magnet.

The invention includes attaching a magnet using an adhesive layer with a peel and stick removable sheet, so that the patch, which contains the magnet, can be attached as a retrofit to existing structures. Any other suitable means to connect the patch to the structure can be used. For example, an adhesive can be applied to the patch, rather than using an adhesive layer and peel and stick sheet. Any suitable adhesives can be used, and can be applied as a spray-on, painted-on, dispensed through an applicator, or other suitable means. Mechanical fasteners may also be used, including screws, tacks, rivots, brackets, etc.

While the illustrated embodiments show attachments at upper surfaces of structures, such as the upper, or outer, surface of a cooler. Where a structure includes outer and inner surfaces, such as the deck of a boat, the patch can be attached to the inner surface, as a means of holding objects out of site and out of the way. In the simplest form, a magnet could be glued to the inner surface of a structure to magnetically hold items like keys, tools or any other objects having ferrous metal components. The invention could include a ferrous metal container, or box, to hold ferrous or non-ferrous metal objects, within the container. The container can be sized and shaped for convenience of the use and location, and available space.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. An apparatus for magnetically attaching two different non-ferrous metal structures, comprising:

a first generally flat patch having a permanent magnet embedded in a first non-metallic material, and defining a first flat upper surface and a first flat lower surface;

a first adhesive film having a first upper surface and a first lower surface, the first lower surface being adhered to the first flat upper surface of the first generally flat patch, and a first peel and stick protective sheet covering the first upper surface that when removed allows the first upper surface to be adhered to a first non-ferrous metal structure;

a second generally flat patch having a ferrous metal plate embedded in a second non-metallic material, and defining a second flat upper surface and a second flat lower surface; and a second adhesive film having a second upper surface and a second lower surface, the second upper surface being adhered to the second flat lower surface of the second generally flat patch, and a second peel and stick protective sheet covering the second lower surface that when removed allows the second lower surface to be adhered to a second non-ferrous metal structure, wherein the first non-ferrous metal structure is different from the second non-ferrous metal structure and wherein the first generally flat patch connects to the second generally flat patch so as to magnetically attach the first non-ferrous metal structure to the second non-ferrous metal structure.

2. The apparatus of claim 1, wherein the permanent magnet creates a magnetic field of sufficient strength to detachably connect the first generally flat patch to the second generally flat patch.

3. The apparatus of claim 1, wherein the ferrous metal plate, when in the influence of a magnetic field generated by the permanent magnet detachably connects the second generally flat patch to the first generally flat patch.

4. The apparatus of claim 3, wherein the permanent magnet is a rare earth permanent magnet.

5. The apparatus of claim 4, wherein the rare earth permanent magnet is made of a neodymium alloy.

6. The apparatus of claim 1, wherein the permanent magnet has a flux density selected to only allow detachment of the first generally flat patch from the second generally flat patch in response to a few foot-pounds of energy.

7. The apparatus of claim 1, wherein the first non-metallic material and the second non-metallic material is a thin, flat, circular plastic encapsulation, and wherein the permanent magnet and the ferrous metal plate are embedded in the plastic encapsulation.

8. The apparatus of claim 1, wherein the second non-ferrous metal structure is a cooler and the first non-ferrous metal structure is an article of drinkware.

9. A combination, comprising:

a cooler made of plastic material and having a substantially flat top;

a first generally flat patch having one of a permanent magnet or a ferrous metal plate embedded in a first shell made of non-metallic material, and defining a first flat upper surface and a first flat lower surface;

a first adhesive film having a first upper surface and a first lower surface, the first lower surface being adhered to the first flat upper surface of the first generally flat patch, and a first peel and stick protective sheet covering the first upper surface that when removed allows the first upper surface to be adhered to a non-ferrous metal structure;

a second generally flat patch having an opposite of one of the permanent magnet or the ferrous metal plate of the first generally flat patch embedded in a second shell made of non-metallic material, and defining a second flat upper surface and a second flat lower surface; and a second adhesive film having a second upper surface and a second lower surface, the second upper surface being adhered to the second flat lower surface of the second generally flat patch, and a second peel and stick protective sheet covering the second lower surface that when removed allows the second lower surface to be adhered to the substantially flat top of the cooler, wherein the first generally flat patch connects to the second generally flat patch so as to magnetically attach the non-ferrous metal structure to the substantially flat top of the cooler.

10. The combination of claim 9, wherein the permanent magnet creates a magnetic field of sufficient strength to detachably connect the first generally flat patch to the second generally flat patch.

11. The combination of claim 9, wherein the permanent magnet is a rare earth permanent magnet made of neodymium alloy.

12. The combination of claim 9, wherein the permanent magnet has a flux density selected to allow detachment of the first generally flat patch from the second generally flat patch by hand with a few foot-pounds of energy and to resist detachment except through the exertion by hand.

13. The combination of claim 9, wherein the non-ferrous metal structure is an article of drinkware.

* * * * *